United States Patent [19]

Russell

[11] 4,329,747

[45] May 18, 1982

[54] SUPPORT PAD

[76] Inventor: Chesley G. Russell, 1103 Meadow Rue, The Woodlands, Tex. 77380

[21] Appl. No.: 146,756

[22] Filed: May 5, 1980

[51] Int. Cl.[3] ..... A45F 3/00; A45F 4/06; A47G 9/06

[52] U.S. Cl. ..... 5/420; 5/481

[58] Field of Search ..... 5/413, 417–420, 5/448, 461, 464, 468, 473, 474, 484

[56] References Cited

U.S. PATENT DOCUMENTS

| | | | |
|---|---|---|---|
| 1,237,243 | 8/1917 | Conner | 5/420 |
| 2,788,533 | 4/1957 | Bornstein | 5/420 X |
| 3,135,974 | 6/1964 | Roman | 5/461 |
| 3,268,922 | 8/1966 | Moxley | 5/420 |
| 3,339,216 | 9/1967 | Ormerod | 5/461 |
| 4,064,578 | 12/1977 | Yamada | 5/481 |

*Primary Examiner*—Stephen J. Novosad

*Attorney, Agent, or Firm*—Pravel, Gambrell, Hewitt, Kirk & Kimball

[57] ABSTRACT

A support pad for sleeping bags and the like is provided. The pad includes a heavy duty material upper portion and fastener structure which permit the pad to be rolled into a compact tubular form and be resistant to damage during storage and transportation.

4 Claims, 4 Drawing Figures

SUPPORT PAD

FIELD OF INVENTION

The present invention relates to support pads such as for sleeping bags and the like.

DESCRIPTION OF PRIOR ART

Although several types of support pads have been available in the past, so far as is known to applicant they have exhibited several undesirable features. Many of these pads have been bulky and difficult to roll into a manageable size for transportation. Further, problems often occurred with snagging and tearing of the covers of these pads due to the use of low grade, light duty covers.

SUMMARY OF INVENTION

Briefly, a support pad for a sleeping bag or the like is provided which includes a mattress pad means for supporting the sleeping bag and a porous upper cover sheet for covering the mattress pad means. A lower cover member in the form of a lower cover slip and a casing cover slip enclose the mattress pad in conjunction with the upper cover sheet. Fastener structure is provided, permitting the pad to be rolled into compact tubular form for transport or storage with the casing cover serving as substantially the entire outer surface of the rolled pad to protect against damage.

DESCRIPTION OF PREFERRED EMBODIMENT

Figure 1:
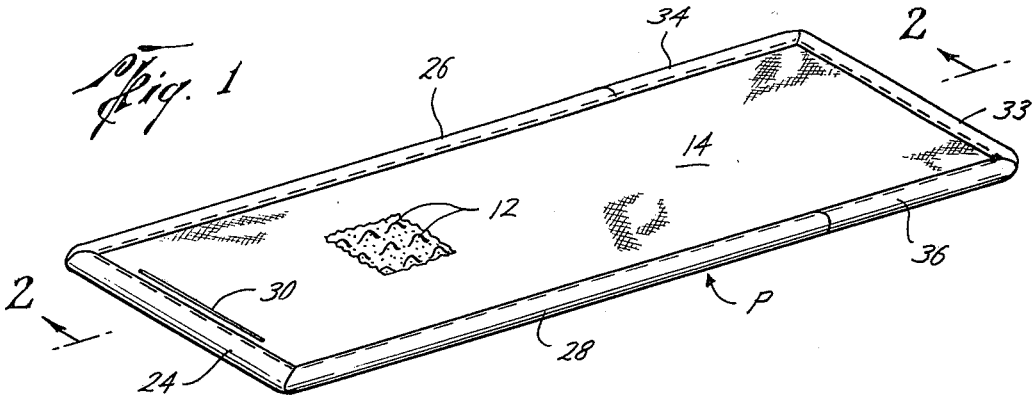
FIG. 1 is an isometric view of a support pad of the present invention.
Figure 2:
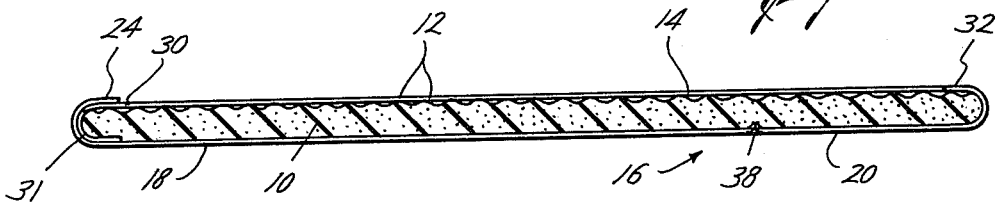
FIG. 2 is a cross-sectional view taken along the lines 2—2 of FIG. 1.

In the drawings, a support pad P for a sleeping bag or the like is set forth. The support pad P may be used for supporting an occupant or occupants of the sleeping bag on an uncovered ground surface, on a tarpaulin or tent floor or the like, or on a cot or mattress, if desired. The support P includes a mattress pad member 10 in the form of a sheet of resilient foam or other suitable material having an undulated upper surface composed of a number of knobs or waves 12. The undulated upper surface of the mattress pad 10 provides cushioning and support for occupants of the sleeping bag which is mounted on the support pad P and further resists any tendency of the sleeping bag to slide or move off of the pad P.

The support pad P further includes an upper cover sheet 14 of a suitable porous material, such as cotton or the like, for covering the mattress pad 10. The porous upper cover sheet 14 permits evaporation of any moisture which might accumulate within the interior of the support pad P. The support pad P further includes a lower cover member 16 which includes a lower cover slip 18 and a casing cover slip 20. Preferably, the casing cover slip 20 is of a heavy duty canvas or like material and is waterproofed. If desired, the lower cover slip 18 may be formed from a lighter duty material and may be waterproofed as well, if desired.

The lower cover slip 18 includes a lower cover sheet 22 mounted beneath the mattress pad 10 when the support pad P is unrolled and an end flap 24 and side flaps

26 and 28 which extend above the mattress pad 10 and are connected to the upper cover sheet 14 by being sewed thereto, or otherwise suitably fastened, in order to enclose the mattress pad 10 therebetween. A service opening or slot 30 is formed in the cover sheet 14 adjacent the end flap 24 so that access is provided so that the mattress pad 10 may be removed for service or the like. The cover sheet 14 includes an inner end flap 31 which extends beneath the end flap 24 and is fastened thereto to maintain the cover sheet 14 in position. It is to be noted that the service opening 30 is at a lower portion of the support pad P so that when the support pad P is being rolled for storage or transportation, any tendency of the mattress pad 10 to move or extrude outwardly through the service opening 30 is precluded.

The casing cover slip 20 is mounted at an upper or head portion of the support pad P and includes a lower cover sheet 32 beneath the mattress pad 10, an end flap 33 and side flaps 34 and 36 which extend above the mattress pad 10 and are connected to the upper cover sheet 14 by being sewn thereto or otherwise suitably fastened to enclose an upper portion of the mattress pad 10 within the support pad P. The casing cover slip 20 and the lower cover slip 18 are fastened together along a common adjoining surface 38 by being sewn or otherwise suitably connected.

Figure 4:
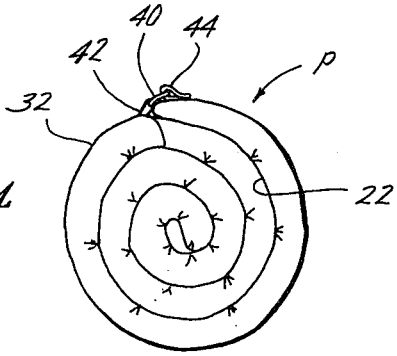
FIG. 4 is a side elevation view of the support pad of FIG. 1 when rolled.

Spaced along the length of the surface 38 between the lower cover slip 18 and the casing cover slip 20 are a number, typically three or mre, of fastener buckles 40 mounted by means of fastener tabs 42 which extend beneath and are sewn to the lower cover slip 18. The fastener tabs 42 may additionally be sewn to, if desired, the outer surface of the casing cover slip 20 for additional strength and support. Each of the fastener buckles 40 coact with one of a plurality of fastener strips 44 to serve as fasteners for retaining the mattress pad 10, the upper cover sheet 14 and the lower cover member 16 of the pad P in compact, tubular form (FIG. 4) when the support pad P is rolled for transportation and storage.

Figure 3:
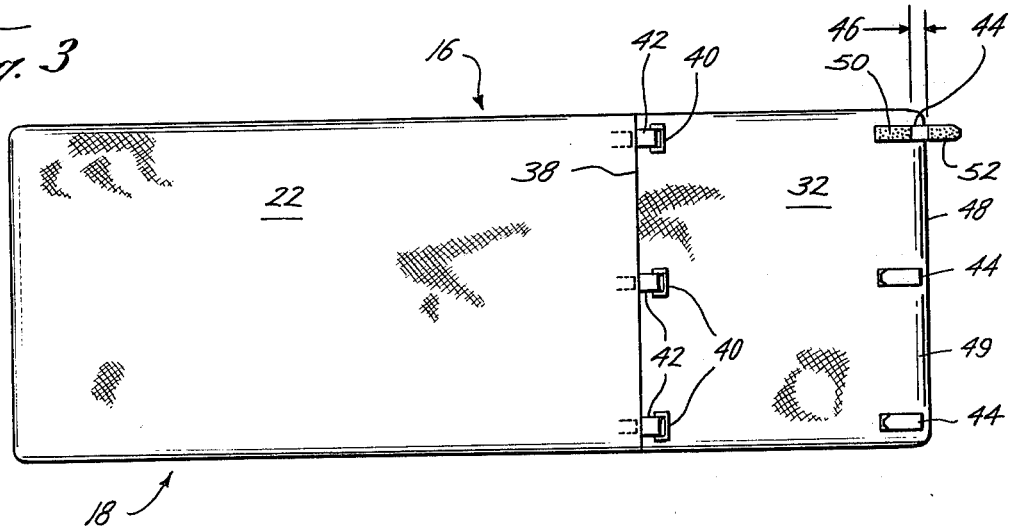
FIG. 3 is a plan view of the bottom side of the support pad of FIG. 1.

The fastener straps 44 are mounted along a lower surface of the cover slip member 20 at a spaced distance, as indicated by arrows 46 from an end portion 48 to provide an overlapping end portion 49 of the casing cover slip 20 so that when the support pad P is rolled (FIG. 4), the heavy duty casing cover slip member 20 covers the substantially entire periphery of the support pad P, protecting the support pad P from snagging or tearing during storage or transportation. The fastener straps 44 are preferably formed from a suitable nylon tape closure, such as that sold under the trademark VELCRO, and include an inner fastener portion 50 mounted with the fastener strap 44 to the casing cover slip 20 and an end fastener portion 52 mounted at an opposite end of the fastener straps 44 from fastener portion 50. The end fasteners 52 are adapted to pass through the fastener buckles 40 and thereafter engage the fastener portion 50 of the fastener strap 44 when the support pad P is rolled. When the end fasteners 52 are so inserted through fastener buckles 40, the fastener buckles 40 and fastener tabs 42 are pivoted to a reverse position (FIG. 4) from that shown in FIG. 3, permitting further reduction of the size of the rolled pad P.

With the tape closure fasteners of the fastener strap 44 according to the present invention, it is to be noted that the size of the support pad P when rolled may be substantially reduced, because of the adjustable, multiple fastening positions available between the fastener members 50 and 52, permitting the support pad P to be rolled into a tight, compact roll for transportation or storage. Further, with the fastener straps 50 and 52 of the present invention, when the support pad P is rolled, substantially the entire outer periphery thereof is formed from the heavy duty casing cover slip 20, for protection against damage during transportation or storage, rendering the support pad P substantially waterproof as well.

From the foregoing, it can be seen that the support pad P affords several advantages, such as reduced size when rolled for transportation and storage, as well as reduced likelihood of damage to the support pad P either from water or snags or tearing when transported and stored, due to the fastener structure of the present invention permitting the support pad P to be rolled to a size such that the heavy duty casing cover member 20 substantially encloses the suppport pad P along the outer periphery thereof.

The foregoing disclosure and description of the invention are illustrative and explanatory thereof and various changes in the size, shape and materials as well as in the details of the preferred embodiment may be made without departing from the spirit of the invention.

I claim:

1. A support pad for a sleeping bag or the like comprising:

(a) mattress pad means for supporting the sleeping bag;

(b) a porous upper cover sheet for covering said mattress pad means;

(c) a lower cover member comprising:

(1) a lower cover slip including a sheet mounted beneath said mattress pad means along a lower portion thereof;

(2) said lower cover slip having an end flap and side flaps extending above said mattress pad means and being connected to said upper cover sheet for enclosing said mattress pad means therebetween;

(3) a casing cover slip including a sheet mounted beneath said mattress pad means along an upper portion thereof;

(4) said casing cover slip being formed from heavy duty canvas or like material having an end flap and side flaps extending above said mattress pad means and being connected to said upper cover sheet for enclosing said mattress pad means therebetween;

(5) said lower cover slip and said casing cover slip being connected together along an adjoining surface thereof opposite said end flaps thereof;

(6) said lower cover slip being formed of different material than said casing cover slip;

(d) fastener means for retaining said mattress pad means, said upper cover sheet and said lower cover member in compact, tubular form when rolled, comprising:

(1) a plurality of fastener buckles anchored by fastener tabs and mounted between said casing cover slip and said lower cover slip;

(2) a plurality of fastener straps for engaging said fastener buckles and mounted with said casing cover slip at an opposite end from said fastener buckles;

(3) each of said fastener straps being formed from plural spaced engageable nylon tape closures, one of which is insertable through one of said fastener buckles and engageable with another of said nylon tape closures to retain said mattress pad means, said upper cover sheet and said lower cover member in compact tubular form when rolled.

2. The support pad of claim 1, further including:

a service opening formed adjacent said end flap of said lower cover slip for providing access to said mattress pad means.

3. The support pad of claim 1, wherein said mattress pad means includes an undulated upper surface.

4. The support pad of claim 1, wherein said fastener straps are mounted on a lower surface of said casing cover slip spaced inwardly from an end portion thereof providing an overlapping end portion of heavy duty material when said support pad is rolled.

* * * * *